US007834733B2

(12) United States Patent
Feist et al.

(10) Patent No.: US 7,834,733 B2
(45) Date of Patent: Nov. 16, 2010

(54) INDUCTIVE COMPONENT

(75) Inventors: Günter Feist, Gingen/Fils (DE); Jürgen Frey, Heidenheim (DE); Karsten Frey, Giengen (DE); Philipp Huemer, Linz (AT); Michael Rottner, Unterhaching (DE)

(73) Assignee: EPCOS AG, Munich (DE)

( * ) Notice: Subject to any disclaimer, the term of this patent is extended or adjusted under 35 U.S.C. 154(b) by 44 days.

(21) Appl. No.: 11/817,940

(22) PCT Filed: Feb. 10, 2006

(86) PCT No.: PCT/EP2006/001249

§ 371 (c)(1),
(2), (4) Date: Sep. 6, 2007

(87) PCT Pub. No.: WO2006/094596

PCT Pub. Date: Sep. 14, 2006

(65) Prior Publication Data

US 2009/0115559 A1 May 7, 2009

(30) Foreign Application Priority Data

Mar. 7, 2005 (DE) ..... 10 2005 010 342

(51) Int. Cl.
*H01F 27/30* (2006.01)
*H01F 17/00* (2006.01)
*H01F 27/28* (2006.01)
*H01F 27/29* (2006.01)

(52) U.S. Cl. ..... 336/198; 336/105; 336/182; 336/192; 336/208

(58) Field of Classification Search ..... None
See application file for complete search history.

(56) References Cited

U.S. PATENT DOCUMENTS

| | | | | |
|---|---|---|---|---|
| 4,503,413 | A | 3/1985 | Stalzer | |
| 4,939,494 | A * | 7/1990 | Masuda et al. | 336/96 |
| 5,977,857 | A * | 11/1999 | Hashimoto et al. | 336/192 |
| 6,162,067 | A * | 12/2000 | Haga | 439/76.1 |
| 6,515,567 | B2 * | 2/2003 | Yeh et al. | 336/192 |
| 6,696,913 | B2 | 2/2004 | Meuche et al. | |
| 6,974,104 | B2 | 12/2005 | Muller et al. | |
| 7,400,224 | B2 | 7/2008 | Feist | |
| 7,479,865 | B2 | 1/2009 | Feist et al. | |
| 7,498,916 | B2 | 3/2009 | Feist et al. | |

(Continued)

FOREIGN PATENT DOCUMENTS

| | | |
|---|---|---|
| AT | 395 492 | 1/1993 |

(Continued)

OTHER PUBLICATIONS

Search Report for PCT/EP2006/001249.

(Continued)

*Primary Examiner*—Elvin G Enad
*Assistant Examiner*—Mangtin Lian
(74) *Attorney, Agent, or Firm*—Fish & Richardson, P.C.

(57) ABSTRACT

An inductive component includes a coil former comprising connection pins, a first winding and a second winding on the coil former, and protective components comprising either a PTC element or a polyswitch. The protective components are connected directly to the coil former; and the protective components and the windings are electrically connected to the connection pins.

10 Claims, 3 Drawing Sheets

U.S. PATENT DOCUMENTS

| | | | | |
|---|---|---|---|---|
| 2001/0026206 | A1* | 10/2001 | Maeda | 336/198 |
| 2002/0196120 | A1* | 12/2002 | Hopkinson et al. | 336/212 |
| 2003/0020580 | A1* | 1/2003 | Jeong et al. | 336/83 |
| 2003/0098769 | A1* | 5/2003 | Cheung et al. | 336/208 |
| 2003/0112960 | A1 | 6/2003 | Wang | |
| 2004/0108401 | A1 | 6/2004 | Muller et al. | |
| 2004/0217837 | A1* | 11/2004 | Orr et al. | 336/182 |
| 2005/0140485 | A1* | 6/2005 | Chang | 336/198 |
| 2006/0139831 | A1 | 6/2006 | Huemer et al. | |
| 2006/0192649 | A1 | 8/2006 | Feth et al. | |
| 2007/0202727 | A1 | 8/2007 | Feist et al. | |
| 2007/0241855 | A1 | 10/2007 | Feist | |
| 2007/0285911 | A1 | 12/2007 | Feist et al. | |
| 2008/0117009 | A1 | 5/2008 | Feist et al. | |
| 2008/0129436 | A1 | 6/2008 | Feist et al. | |
| 2008/0164968 | A1 | 7/2008 | Feist et al. | |
| 2009/0152003 | A1 | 6/2009 | Feist et al. | |

FOREIGN PATENT DOCUMENTS

| | | | | |
|---|---|---|---|---|
| AT | 395492 | B | * | 1/1993 |
| DE | 8136815 | U1 | * | 12/1981 |
| DE | 30 35 053 | | | 3/1982 |
| DE | 81 36 815.1 | | | 5/1982 |
| DE | 100 17 661 | | | 2/2002 |
| DE | 100 56 945 | | | 8/2003 |
| EP | 1 128 651 | | | 8/2001 |
| JP | 04-214609 | | | 8/1992 |
| JP | 04214609 | A | * | 8/1992 |
| WO | WO03/063188 | | | 7/2003 |

OTHER PUBLICATIONS

Written Opinion for PCT/EP2006/001249.

English Translation of International Preliminary Report on Patentability in Application No. PCT/EP2006/001249, dated Sep. 12, 2007.

* cited by examiner

INDUCTIVE COMPONENT

TECHNICAL FIELD

Inductive components may be in the form of inductors or transformers, for example, or, as an inductance, may be part of electrical circuits.

BACKGROUND

In electrical circuits, particularly in the low-voltage range, in the case of noise-sensitive lines in communication engineering and information technology and in the case of sensitive electronic components, it is possible to use protective components. These can be used to render inadmissibly high currents or voltages harmless and to discharge them to ground or to convert them into heat energy. This allows the components to be protected from inadmissible heating, which can at least cause a fault in component operation, and, in the extreme case, from destruction.

Various types of protective components are known which can be used according to the desired operation and, if appropriate, can also be combined with one another. To protect against excessive currents and voltages, it is possible to use arrestors, thermistors or varistors, for example.

Normally, protective components are used as separate components and are soldered on boards, for example. In this context, however, each soldered component requires a provided electrical leakage path, for which it is necessary to observe a certain clearance from the adjacent component. Boards to which components are fitted automatically also require a certain clearance between individual components so that the component fitting machine can set down the component with certainty or possibly grip it again too. This results in a high space requirement overall on boards which goes beyond the sum of the component dimensions themselves. Not least for this reason, attempts are therefore often made to combine different component functions on modules, specifically on the one hand to improve performance but on the other hand to save space on the board.

SUMMARY

The basic idea is to combine an inductive component with a protective component and to amalgamate this into a joint component. To this end, the inductive component, which comprises at least one coil former having a first winding and connection pins which are fitted on the coil former, is connected directly to a protective component by the coil former. The inductive component can be handled together with the protective component like a single component, and can be fitted onto a board like a single component. This means that the component does not require the leakage paths and clearances between the inductive component and the protective component which otherwise need to be observed and which would otherwise be necessary for fitting and removal operations, for example, in the case of separate components.

The component can be electrically and mechanically connected to an external circuit environment, e.g., a board, by the connection pins. This applies both to the inductive component and to the protective component, which is likewise electrically connected to the connection pins and therefore does not require any separate connections. For the protective component, it is possible to provide separate connection pins on the coil former. However, it is also possible for the inductive component and the protective component to be connected to the same connection pins, so that this can actually achieve serial or parallel connection of inductive component and protective component via the connection pins.

The protective component may be in cuboid form. In particular, it may comprise a ceramic component body which comprises at least two electrodes arranged on opposing main surfaces of the component body. Cuboid component bodies have the advantage that they can be arranged in numbers in extremely space-saving fashion, particularly including in connection with other, different components of rectangular cross section or component bodies of other protective components. The coil former also comprises lateral faces, at least three edges of which follow a rectangle. The fourth upper edge of the lateral face of an inductive component can follow the winding, which is usually routed over a round winding body, and may also be rounded, for example. It is therefore advantageous to connect the protective component to a lateral face of the coil former. From there, it is possible in a particularly simple manner to connect the electrodes of the protective component to the connection pins of the coil former by connecting wires which are soldered onto the electrodes.

By way of example, the protective component may be in the form of a PTC resistor and can protect the inductive component from excessive currents. A polyswitch is also suitable as a protective component and is distinguished by an on-state response which has even lower resistance than the PTC resistor. With large currents, the polyswitch also changes to high resistance and turns off.

However, it is also possible to provide the protective component not only for protecting the inductive component but also for protecting circuits, components and appliances which are electrically connected to the inductive component and/or to the protective component.

It is advantageous if the size of the protective component which is required for the protective function of the protective component is in the same order of magnitude as that of the inductive component. In this way, the relatively largest space gain is obtained on a board on which the inductive component can be connected.

A further space gain on the board on which the inductive component is fitted is obtained by arranging the protective component within the external dimensions of the inductive component, comprising coil former, winding and magnetic core, which first ensures the full component function of the inductive component. Such an arrangement is obtained, by way of example, when the protective component is arranged below the winding. By way of example, the coil former may comprise a base having a recess which contains the protective component. This recess may be accessible from below or outside and may be arranged symmetrically below the winding.

In another refinement, the coil former comprises at least one second winding, by which a second current path is defined. The second current path can also be protected with a further second protective component, which is then likewise mounted on the coil former. The two windings can be arranged with electrical insulation above one another. However, it is also possible to arrange the two windings next to one another on the coil former. Accordingly, the protective components can also be arranged next to one another, for example below a respective winding.

The coil former may comprise chambers which are open at the bottom, with a respective chamber possibly being provided per winding. A respective ceramic protective component can be inserted into the chambers. The interior of the chambers may match the external dimensions of the protective component. Each protective component may comprise two connecting wires which are mechanically and electrically connected to the connection pins on the coil former.

In one possible embodiment, the coil former is connected to a magnetic core of EP type, or is arranged in a half-shell core of this kind. The EP core encloses the coil former at least on the four outer sides and is open at the bottom. If the coil former has a base which follows the external dimensions of the EP core then sufficient volume is available for the base to contain a number of protective components which corresponds to the number of windings.

The protective components may have the shape of shallow cuboids and may be geometrically oriented in the base such that they have a side or end face pointing downward while the larger main surface points to the side. In the case of a coil former having at least two windings arranged next to one another, the cuboid protective components may also be arranged transversely with respect to the main axis of the coil former, with the main axis corresponding to the magnetic axis and therefore following the central section of the EP core. This is easily assisted by virtue of each winding being arranged in a winding chamber which is bounded on both sides transversely with respect to said main axis by flanges which continue downward into the base. The cavity provided there is then divided by the extended flange into a corresponding number of chambers which are respectively arranged below a winding body and are provided for the purpose of holding a respective protective component.

The two outermost flanges or their extension downward form two lateral faces of the coil former, may comprise reinforced sections and are provided with the connection pins in the reinforced sections. These connection pins may have been inserted, sealed, clipped or screwed into the coil former.

The connection pins may be L pins which allow the inductive component to be soldered using an SMD design. The coil former may comprise four connection pins per winding, with two respective connection pins being provided for the winding and two respective connection pins being provided for the protective component. However, it is also possible to achieve serial connection of the winding and the protective component with three connection pins per winding, with one of the connection pins being connected both to the protective component and to a winding.

An inductive component having two or more windings may be in a form of a transformer, where the windings may differ in terms of the number of turns in them. In one such transformer, different protective components may be provided for different windings.

However, the windings may also be identical, so that the two coils in the finished component have the same inductance values. In this case, the protective components may be identical, so that overall a component having a high level of symmetry is obtained. An inductive component having two windings which are connected to a magnetic EP core and two PTC resistors or polyswitches as protective components may advantageously be used in a low-pass filter which firstly isolates the voice signal from the ADSL line and secondly protects it against excessive currents. In this application, the high level of symmetry which can be obtained with the combination of the inductive component and the protective component is advantageously used to obtain the signal symmetry in the two current paths of the ADSL line.

A low-pass filter of this kind comprises a parallel circuit containing a capacitance and an inductance, which is implemented using the inductive component. A series resistor which is also required for the low-pass filter is implemented by the series resistance of the winding. In the inductive component, each inductance implemented by a winding and a magnetic core, respectively, is associated with a respective low-pass filter for a respective one of the two data lines in the ADSL line. For this application, it is also advantageous for the necessary space requirement for the protective component and the coil former to be able to be tuned to one another such that the protective component or components can be comfortably integrated into the base of the coil former.

Embodiments are described below with reference to associated figures. These serve merely for a better understanding and are therefore merely schematic and not to scale. Parts which are the same or have the same action are denoted by the same reference symbols.

DETAILED DESCRIPTION

Figure 1:
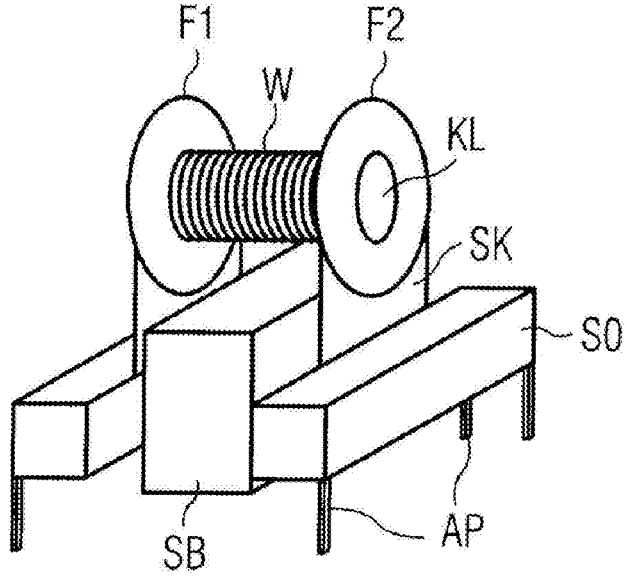
FIG. 1 shows an inductive component having a winding.

FIG. 1 shows a simple schematic illustration of an inductive component having a protective component in perspective view. The coil former SK comprises a drum-like winding body which is provided with flanges F1, F2 on both sides. Between the flanges F, the winding W is fitted on the winding body. The flanges F extend downward into a base SO, which may be widened in the lower region, so as to ensure that the connection pins AP are held securely there. Arranged and mechanically attached between the two flanges which have been extended to the base is a protective component SB. By way of example, it may be attached merely by jamming the protective component SB between the flanges, which are equipped with a certain elasticity and extended to the base. By way of example, the protective component is a ceramic component body made of PTC material which is provided with a respective electrode on the two main surfaces facing the flanges. Electrical connection of the protective component SB is made via two connecting wires which are soldered to a respective electrode and are connected to a respective connection pin AP of the coil former SK (not shown in the figure).

In the center, the winding body has a core hole KL into which a magnetic core, for example the central section of an E core and particularly of an EP core, can be inserted in order to complete the inductive component. The protective component takes up the space between the two flanges in the base SO completely and may end with the bottom edge of the base and the end face of the base.

The figure does not show wire guide slots and possible mechanical reinforced sections on the coil former which can increase the stability of the structure. In addition, the coil former may comprise a cross brace, connecting the two flanges and fixing the protective component SB in its position, on at least one from the underside, the front or the back. However, at least one side may be open in order to allow the protective component SB to be easily fitted into the coil former SK.

Figure 2:
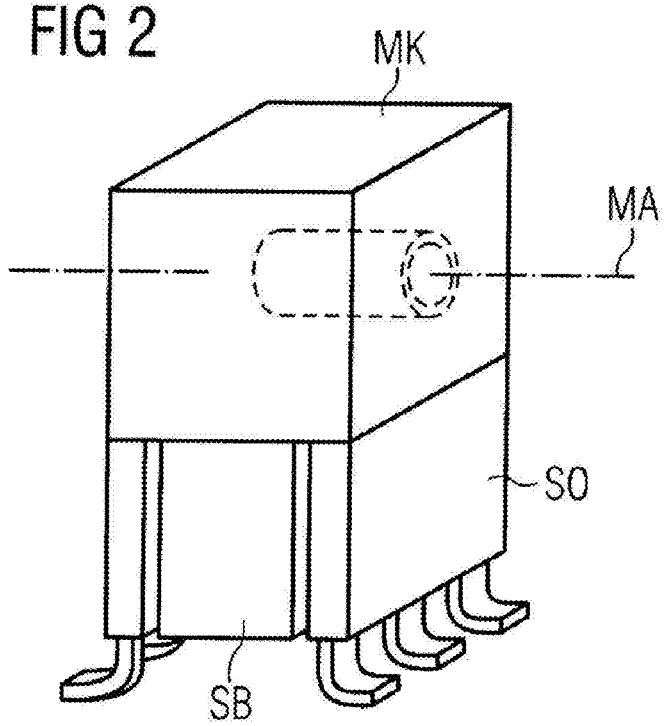
FIG. 2 shows another component having a magnetic core.

FIG. 2 shows a similar embodiment in a perspective illustration, with a magnetic core MK, in this case an EP core closed at the top, having already been pushed on over the coil former in this case. The magnetic axis MA which coincides with the central section of the EP core is indicated. In this case too, the coil former is extended below the magnetic core MK to a base SO which comprises at least two lateral parts between which the cuboid component body of a protective component SB is arranged and attached. In this case, the connection pins are in the form of L pins.

Figure 3:
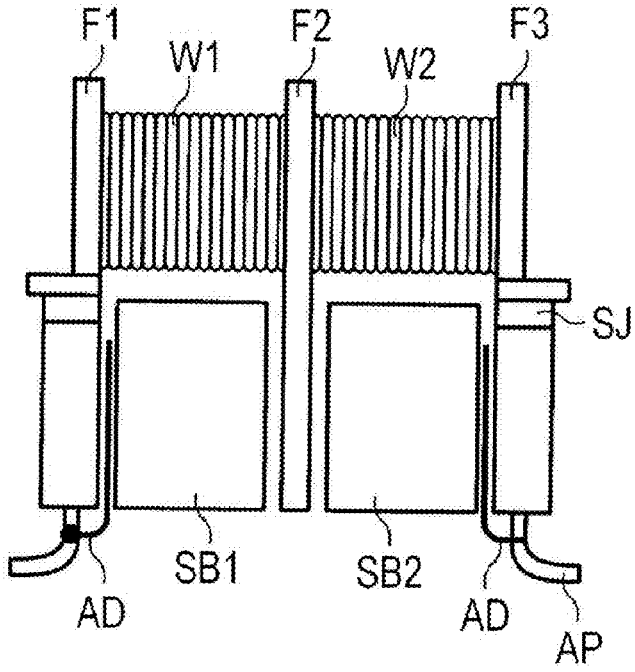
FIG. 3 shows an inductive component having two windings and two protective components from the side.

FIG. 3 shows another embodiment of the inductive component from the side. This coil former has two windings W1, W2 which are arranged in a respective winding chamber formed between two respective flanges F1, F2 and F2, F3. Each of the three flanges is extended downward to the base SJ. Formed in the base between two respective flanges is a chamber which contains a respective protective component SB1, SB2. In the top region of the base SJ, a wire guide slot is indicated in which, by way of example, one end of the winding W can be routed out and guided securely to a connection pin AP. Corresponding further wire guides may also be arranged in a vertical direction. The connecting wires AD of the protective components SB are likewise routed to the connection pins.

Figure 4:
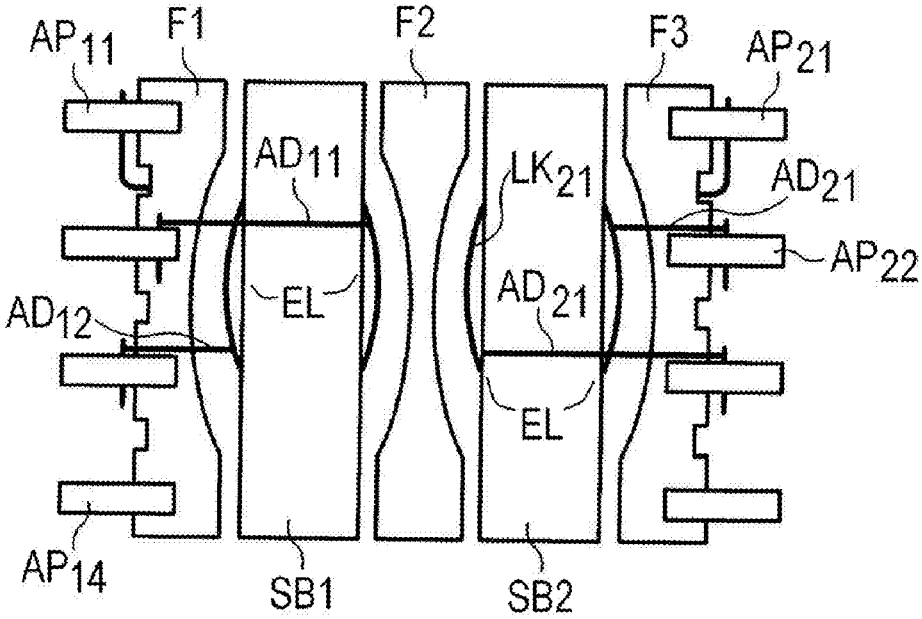
FIG. 4 shows the component from below.

FIG. 4 shows this or a similar component in a view from below. It shows the bottom edges of the three flanges F1 to F3 with respective protective components SB1, SB2 arranged between two flanges. Each of the two outer flanges F1, F3 bears four respective connection pins AP and is reinforced as appropriate to this end. The central flange F2 without connection pins may be made thinner in relation thereto.

The figure also shows that the protective components SB comprise a central solder contact LK by which a respective connecting wire AD is connected to the respective electrode EL on the main surface of the protective component SB. To provide space for this solder contact and the connecting wire connected thereto, the flanges F may be in appropriately concave form in the center, as is clearly visible in the figure. In the concave region of the flanges, the connecting wires AD of the protective components SB are also routed to the underside of the coil former and from there via the bottom edge of the outer flanges to the connection pins AP and are attached there. The two remaining connection pins are connected to the two ends of the respective winding.

A component which comprises more than two windings then also comprises a correspondingly larger number of protective components and, for the purpose of making electrical contact, also a correspondingly larger number of connection pins.

Figure 5A:
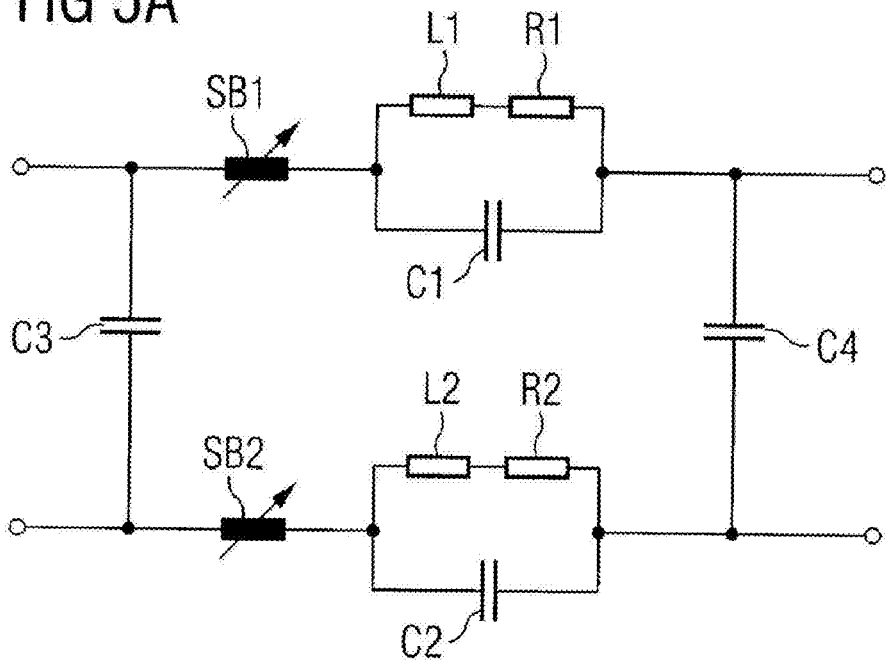
FIG. 5 shows the connection of the component with the aid of an equivalent circuit diagram.

FIG. 5 shows an electrical equivalent circuit diagram for an application of the inductive component within a low-pass filter which can be fitted in a communication line, for example an ADSL line, and uses the protective component SB to protect the communication line from excessive currents. In each of the two lines, the low-pass filter is formed by connecting an inductance L1 or L2 and a capacitance C1 or C2 in parallel, the inductance respectively being connected in series with a resistor R1 or R2. A respective protective component SB1 or SB2 is connected in series with the low-pass filter. Between the two low-pass filters, a respective capacitance C3 or C4 is connected in two shunt arms. The two inductances L1, L2 are implemented using the inductive component, while the resistor R is respectively obtained from the series resistance of the winding. The capacitances may be in the form of separate components. It is also possible to adapt the circuit additionally and to perform matching for the resistors. The high level of symmetry in the arrangement in terms of the identical values for the inductance L and the resistor R makes it possible to prevent the signals routed in the two signal lines from distorting one another, so that no loss of information content arises in the ADSL line either.

Figure 5B:
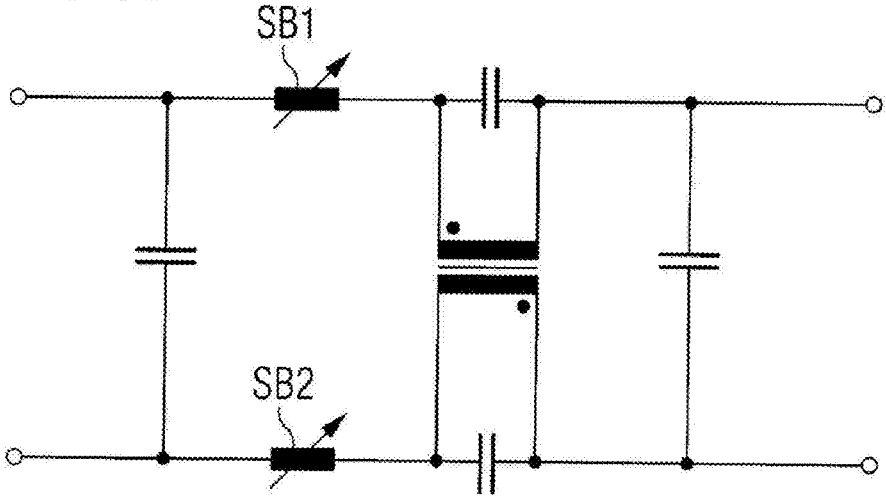

The interconnection which can be produced with the inductive component is illustrated by the equivalent circuit diagram shown in FIG. 5*b*. The two inductances implemented in the two low-pass filters by a common magnetic core within a single inductive component are magnetically oriented such that their magnetic fields cancel one another out. This is implemented by opposite directions of winding, as indicated by the relevant dot in the equivalent circuit diagram.

Although only a few exemplary embodiments have been described, the claims are not limited thereto. With regard to the precise refinement of the coil former, a large number of variations in structure and design of the coil former are possible which are known per se and can be implemented together with the new inductive component. The attachment of the protective components can be produced below the component between two appropriately extended flanges. However, it is also possible to narrow the base and to arrange the protective components externally on the lateral wall of the base. The chambers, which are merely shown open, may also be closed on further sides or at the bottom. The protective components are shown as cuboid, in particular ceramic, component bodies but may also have external dimensions which differ therefrom. By way of example, it is possible to use protective components which, in the form of shallow cylinders, comprise a round or elliptical main surface.

With regard to the utilization of space and the associated electrical properties of the protective components, the cuboid and, in particular, shallow form of protective components may be used, however. It is also possible, when there are a plurality of protective components in the inductive component, for the protective components to be arranged not in succession but rather next to one another in the direction of electrical flow. The two or more protective components may also be arranged transversely or parallel with respect to the magnetic axis. Arranging the protective components externally on the coil former also allows protective components to be arranged on both sides on the base of the coil former.

In addition to application in a low-pass filter, an inductive component may be used in any other circuits. In this case, it is not necessary for the protective component and the inductance to be connected to one another immediately and directly. Since each winding and each protective component can be routed to separate connection pins of the coil former, it is possible for the inductance and the protective component to be connected as desired via the board, so that the two units can be used in one application in isolation from one another.

What is claimed is:

1. An inductive component comprising:

a coil former comprising connection pins;

a first winding and a second winding on the coil former;

protective components comprising either a PTC (Positive Temperature Coefficient) element or a polyswitch;

wherein the protective components are connected to the coil former;

wherein the protective components and the first and second windings are electrically connected to the connection pins, the protective components being electrically connected to the connection pins former via connecting wires;

wherein the coil former comprises a winding chamber for each winding, each winding chamber being bounded by a flange that extends toward a base;

wherein the base comprises a protective component between two flanges;

wherein outer flanges hold the connection pins; and wherein the protective components are electrically connected in series with the first and second windings.

2. The inductive component of claim 1, wherein the protective components are cubical in shape.

3. The inductive component of claim 1, wherein the protective components comprise a ceramic component body comprising two electrodes that are on opposing sides of the ceramic component body.

4. The inductive component of claim 1, wherein the coil former comprises two chambers that are open at bottom and into which a respective ceramic protective component is inserted.

5. The inductive component of claim 1, wherein the coil former is plugged into an EP-type magnetic core.

6. A low-pass filter within an ADSL (Asymmetric Digital Subscriber Line) line, the low-pass filter comprising an inductive component, the inductive component comprising:

a coil former comprising connection pins;

a first winding and a second winding on the coil former;

protective components comprising either a PTC (Positive Temperature Coefficient) element or a polyswitch;

wherein the protective components are connected to the coil former;

wherein the protective components and the first and second windings are electrically connected to the connection pins, the protective components being electrically connected to the connection pins former via connecting wires;

wherein the coil former comprises a winding chamber for each winding, each winding chamber being bounded by a flange that extends toward a base;

wherein the base comprises a protective component between two flanges;

wherein outer flanges hold the connection pins;

wherein the protective components are electrically connected in series with the first and second windings.

7. The inductive component of claim 6, wherein the protective components comprise a ceramic component body comprising electrodes that are on opposing sides of the ceramic component body.

8. The inductive component of claim 6, wherein the coil former comprises two chambers that are open at bottom and into which a respective ceramic protective components is inserted.

9. The inductive component of claim 8, wherein the coil former is plugged into an EP-type magnetic core.

10. The inductive component of claim 1, wherein there are two protective components.

* * * * *